United States Patent [19]

Kifer

[11] Patent Number: 4,526,407

[45] Date of Patent: Jul. 2, 1985

[54] ROOF FLASHING

[75] Inventor: David E. Kifer, Parma, Ohio

[73] Assignee: Oatey Co., Cleveland, Ohio

[21] Appl. No.: 257,936

[22] Filed: Apr. 27, 1981

[51] Int. Cl.[3] ..... E04B 5/48

[52] U.S. Cl. ..... 285/42; 285/284; 285/330; 285/423; 264/273

[58] Field of Search ..... 285/42, 43, 44, 284, 285/290, 423, 330; 52/56, 60, 219; 264/255, 262, 263, 273, 274

[56] References Cited

U.S. PATENT DOCUMENTS

| | | | |
|---|---|---|---|
| 1,287,235 | 12/1918 | Cole | 285/44 |
| 1,615,925 | 2/1927 | Buckles et al. | 285/43 |
| 4,265,058 | 5/1981 | Logsdon | 285/43 X |

FOREIGN PATENT DOCUMENTS

| | | | |
|---|---|---|---|
| 1355517 | 6/1974 | United Kingdom | 52/219 |

*Primary Examiner*—Dave W. Arola

*Attorney, Agent, or Firm*—Maky, Renner, Otto & Boisselle

[57] ABSTRACT

A roof flashing and method of making same in which both the collar and base member of the flashing are made of elastomeric material. The base member is molded first and has an opening therein surrounded by a stepped flange provided with a series of circumferential slots therein. The collar is molded onto the base member during a subsequent molding operation in which the material of the collar is injected through the slots and completely around the top, bottom and inner side edge of the flange to form a series of closed loops thus providing a positive mechanical lock between the collar and base member. Also, the heat of the elastomeric material of the collar during the second stage molding process causes some melting of the elastomeric material of the base member whereby the collar and base are also fused together.

17 Claims, 4 Drawing Figures

ROOF FLASHING

BACKGROUND OF THE INVENTION

This invention relates generally as indicated to a roof flashing and method of making same in which the entire flashing including both the collar and base member are made of elastomeric material.

It is well-known to make the collar portion of a roof flashing out of a suitable elastomeric (plastic) material which forms an effective weather-proof seal around an upstanding pipe and the like protruding through the sloping roof of a building. However, heretofore it was the usual practice to make the base member out of metal, and provide a mechanical joint between the base member and collar. One such roof flashing which has been very well received and widely used and accepted throughout the industry is shown in applicant's own U.S. Pat. No. 3,313,559 assigned to the same assignee as the present application. However, the use of such a metal base adds considerably to the cost and weight of such a roof flashing. Also, such a metal base is more bulky to ship and store, and is susceptible to damage by bending or denting same.

To eliminate these objections, considerable efforts have been put into making the base member as well as the collar out of plastic, with varying degrees of success. There are, for example, some all-plastic roof flashings in which both the collar and base member are integrally molded as a single unit. However, this is an expensive molding operation, and places some restrictions on the type of seal that can be formed between the collar and pipe. Also, this requires that the base member be made out of the same elastomeric material as the collar, which may unnecessarily add to the cost of the flashing, in that the material specifications for the collar are much more demanding than those for the base member, because of the requirements of the collar to be sufficiently flexible and pliable in order to form the desired fluid-tight seal with a range of pipe sizes on different pitched roofs.

Efforts have also been made to make the collar and base member separately so that different types of elastomeric materials could be used for each member. However, this creates additional problems in how to provide a secure and effective joint or connection between the collar and base member. Mechanical connections of one type or another have been tried, but they have generally not been very successful in that they are susceptible to being pulled apart, and also add considerably to the overall cost of manufacture and assembly of the flashing.

SUMMARY OF THE INVENTION

With the foregoing in mind, it is the principal object of this invention to provide an all-plastic roof flashing and method of making same which overcomes the various problems enumerated above.

Another object is to provide such a roof flashing and method by which the collar and base member are molded in a two step molding operation which permits different elastomeric materials to be used for each part.

Another object is to provide such a roof flashing and method in which an absolutely secure, fluid-tight connection is provided between the collar and base portion.

Still another object is to provide such a roof flashing and method in which both a mechanical lock and material bond are provided between the collar and base member.

These and other objects of the present invention may be achieved by making such roof flashing in a two-step molding process. The base member of the flashing is molded first, and is provided with a central opening therethrough, surrounded by a stepped flange provided with a series of circumferential slots therein. Next the collar is molded directly onto the base member, during which the material of the collar is injected through the slots and completely around the top, bottom and inner side edge of the base flange thus forming a series of closed loops to provide a secure, positive mechanical lock between the collar and base member. In addition, the heat of the elastomeric material of the collar during the second stage molding process causes some melting of the material of the base member to fuse the two materials together.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
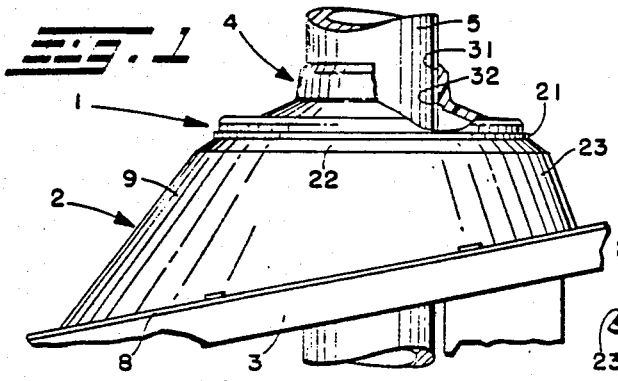
FIG. 1 is a side elevation view, partly in section, of a preferred form of roof flashing in accordance with this invention shown in the assembled condition on a roof providing a fluid-tight seal with an upstanding pipe extending through the neck portion of the collar.

Referring now in detail to the drawing, and initially to FIG. 1, a preferred form of roof flashing in accordance with this invention is generally indicated by the reference numeral 1, and comprises a base member 2 adapted to be secured to a roof structure 3 and a collar portion 4 operative to provide a fluid-tight seal with an upstanding member such as a pipe 5 projecting upwardly through the roof.

Figure 2:
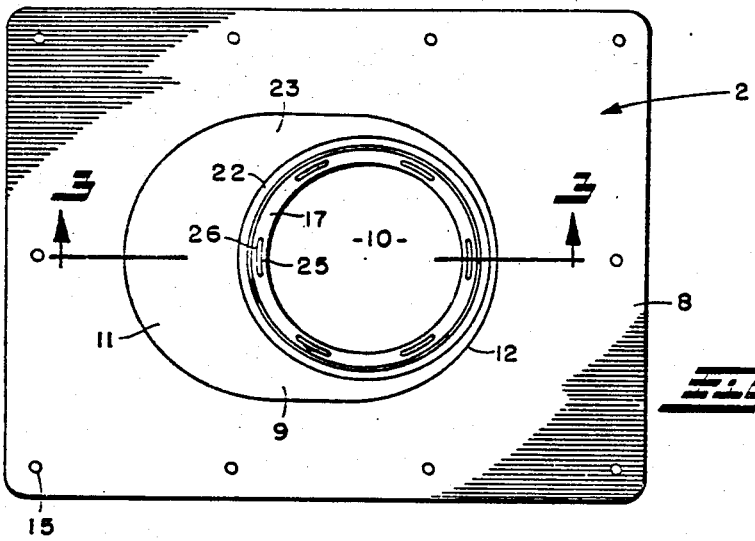
FIG. 2 is an enlarged top plan view of the base member of the roof flashing of FIG. 1 prior to molding the collar thereto.
Figure 3:
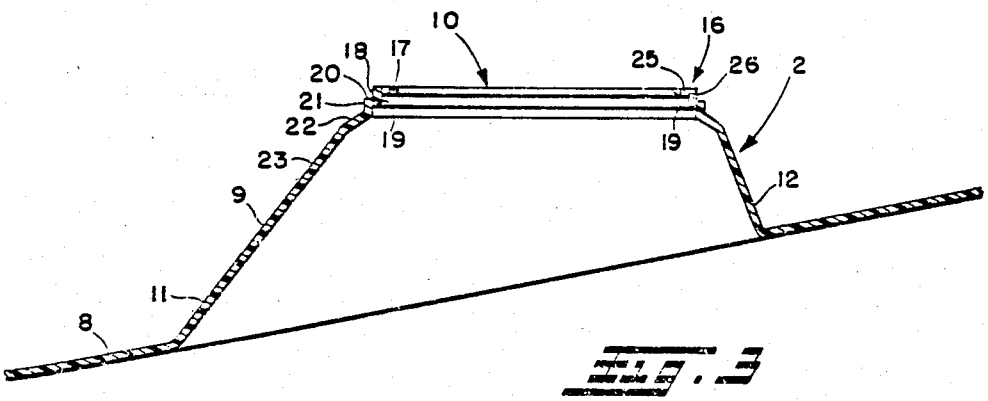
FIG. 3 is an enlarged fragmentary vertical section through the base portion of FIG. 2, taken on the plane of the line 3—3 thereof.

As best seen in FIGS. 2 and 3, the base member 2 desirably consists of a flat rectangular base plate 8 having an upstanding central dome portion 9 with an enlarged central opening 10 extending through the apex thereof. The central dome portion 9 desirably has a much greater slope and vertical height relative to the base plate adjacent one end 11 than at the other end 12 so that when the base plate is mounted on a sloping roof at an angle as shown, for example, in FIGS. 1 and 3, the axis of the central opening 10 in the dome portion 9 will be substantially parallel to the axis of the pipe 5 extending upwardly therethrough. Also, the diameter of the central opening 10 in the base member 2 is desirably substantially larger than the diameter of the pipe 5 so that the pipe does not interfere with the flat engagement of the base plate 8 against the roof regardless of the angle of slope or pitch of the roof.

The base member 2 is preferably molded out of a semi-rigid elastomeric material, and desirably has a substantially uniform wall thickness, for example, of 0.075" throughout. During the molding process, a series of small indentations 15 may be formed in the top surface of the base plate 8 around the periphery thereof as shown in FIG. 2 to provide nail locators for nailing the base portion to the roof structure. Also, a light textured finish may be provided on the top surface of the base portion.

Adjacent the upper end of the central dome portion 9 is a stepped flange 16 including at its uppermost end a radially inwardly extending annular lip portion 17 surrounding the central opening 10 therein. From the outer periphery of the annular lip 17 the flange 16 extends generally axially inwardly a short distance to provide both external and internal cylindrical surfaces 18, 19, respectively, for a purpose to be subsequently described. Extending radially outwardly from the axial inner end of the external cylindrical surface 18 is a relatively short annular radial shoulder 20 on the exterior of the dome portion. From the radial shoulder 20 the dome portion 9 preferably extends generally axially inwardly at 21 for a short distance and then radially outwardly at 22 at a slight angle until it blends with the major conical portion 23 of the dome.

Within the annular lip 17 itself are a series of circumferentially spaced elongated arcuate slots 25 which aid in the formation of an absolute, positively secure mechanical lock between the collar portion 4 and base member 2 in a manner to be subsequently described. Preferably six equally spaced slots 25 are provided in the annular lip portion, each approximately ¾" long and 0.075" wide. The radial outer side 26 of each slot is also desirably in the same axial plane as the internal cylindrical surface 19 to permit the width of the lip portion to be kept to a minimum while still maintaining the minimum wall thickness of approximately 0.075" throughout.

Figure 4:
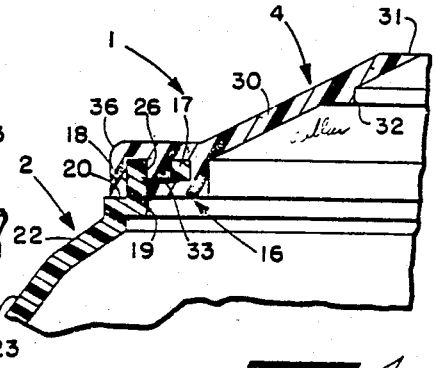
FIG. 4 is an enlarged fragmentary vertical section through the interconnection between the base member and collar showing the manner in which the collar is securely attached to the base member during the second stage molding process.

The collar 4 may also be made from a commercially available elastomer, but the material of the collar must be very flexible and pliable so the collar can be stretched and distended upwardly in order to fit over a pipe and form the desired fluid-tight seal therewith as illustrated in FIG. 1. Prior to insertion over a pipe, the collar is preferably in the shape of a thin walled truncated cone 30 as shown in FIG. 4, and may be provided with two or more sealing edges or ribs 31 and 32 adjacent the apex end of the collar, similar to that shown in U.S. Pat. No. 3,313,559, the disclosure of which is incorporated herein by reference.

The roof flashing 1 is preferably made in a two-step molding process, with the base member 2 of the flashing being molded first in the configuration previously described, followed by a subsequent molding operation in which the collar 4 is molded directly onto the upper end of the base member. During such second stage molding process, the material of the collar is injected through each of the elongated slots 25 in the annular lip 17 at the upper end of the base member and completely around the top, bottom and radial inner side edge of the annular lip thus forming a series of closed loops 33 between the collar and base member through each of the slots to provide a positive, secure mechanical lock between the base member and collar which absolutely prevents them from being pulled apart except by tearing the material of the collar or base member. The material of the collar also desirably wraps around the external cylindrical surface 18 of the base member to aid in the formation of a fluid-tight joint therebetween. As clearly shown in FIG. 4, the axial length of the external cylindrical surface is desirably at least twice the wall thickness of the collar in the region of the external cylindrical surface.

The wall thickness of the elastomeric collar 4 is desirably substantially uniform throughout, including the wall thickness surrounding the top, bottom, and inner side edge of the annular lip portion and external cylindrical surface 18 as shown in FIG. 4. The radial shoulder 20 at the axial inner end of the external cylindrical surface 18 may be somewhat wider than the wall thickness of the collar as shown in FIG. 4 to provide a shut-off point for the material of the collar during the second stage molding process. However, generally speaking the axially extending portion 21 of the base cone 9 adjacent the radial shoulder 20 provides a substantial continuation of the outer surface of the collar to form a relatively smooth transition joint therebetween which aids in the running off of water, ice and snow from the collar and base member. Also, the radial outer edge of the collar where it wraps around the external cylindrical surface 18 of the base member 2 is desirably slightly radiused as shown at 36. The shut-off point for the material of the collar adjacent the bottom surface of the annular lip portion 17 is on the internal cylindrical surface 19 which extends axially inwardly below the bottom of the collar as further shown in FIG. 4.

In addition to the aforementioned mechanical lock that is formed between the base member and collar, there is also a plastic bond therebetween which results because of the heat of the elastomeric material of the collar which causes some melting of the material of the base member during the second stage molding process to fuse the two members together.

Although it is desirable that the base member 2 include a central dome portion 9 to continue the slope of the collar 4, it should be understood that the dome portion could be eliminated and the collar attached directly to an apertured flange surrounding a central opening in the base plate 8 if desired. Also, while the roof 3 is illustrated in FIG. 1 as having only a slight inclination, it should readily be apparent that the roof flashing 1 of the present invention may also just as effectively be used to provide a seal around pipes protruding from roofs of almost any pitch or slope as long as the elastomeric collar is sufficiently resiliently deformable and the central opening 10 in the base member 2 is sufficiently large to avoid contact with the pipe.

From the foregoing, it can now be seen that the roof flashing and method of the present invention permit both the base member and collar to be made out of the same or different types of elastomeric material in a two-step molding process which results in a completely secure leak-proof joint therebetween.

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

The embodiments of the invention in which an exclusive property or privilege is claimed are defined as follows:

1. A roof flashing comprising a base member adapted to be secured to a roof, and a collar for establishing a weather-proof seal with an upstanding pipe passing through an opening in such roof, both said base member and collar being made of an elastomeric material, said base member having an opening therein surrounded by a stepped flange, said stepped flange including a radially inwardly extending annular lip portion having a plurality of circumferentially spaced slots therein, and an external cylindrical surface extending axially inwardly from the radial outer edge of said annular lip portion, the material of said collar extending through said slots and wrapping around said annular lip portion to form a series of closed loops providing a positive mechanical lock between said collar and base member, said collar also extending around said external cylindrical surface, said external cylindrical surface having an axial length greater than the wall thickness of said collar in the region of said external cylindrical surface, said collar extending substantially the full length of said external cylindrical surface in sealing engagement therewith to aid in the formation of a fluid-tight joint between said collar and base member.

2. The roof flashing of claim 1 wherein the axial length of said external cylindrical surface is at least twice the wall thickness of said collar in the region of said external cylindrical surface.

3. The roof flashing of claim 1 wherein the material of said collar extends all the way around the top and bottom surfaces and radial inner edge of said annular lip portion and along the entire length of said external cylindrical surface.

4. The roof flashing of claim 1 wherein said stepped flange also has a radially outwardly extending shoulder adjacent the axial inner end of said external cylindrical surface, said collar extending along the full length of said external cylindrical surface and terminating at said shoulder.

5. The roof flashing of claim 4 wherein said shoulder has a width slightly greater than the thickness of said collar along said external cylindrical surface, and said base member has an axially inwardly extending portion at the radial outer edge of said shoulder providing a substantial continuation of the outer surface of said collar to form a relatively smooth transition joint between said collar and base member.

6. The roof flashing of claim 1 wherein said stepped flange also has an internal cylindrical surface extending axially inwardly from the bottom surface of said annular lip portion, said collar overlying the entire bottom surface of said annular lip portion and terminating at said internal cylindrical surface.

7. The roof flashing of claim 6 wherein the axial length of said internal cylindrical surface is greater than the wall thickness of said collar in the region of said internal cylindrical surface, said internal cylindrical surface extending axially below the end portion of said collar which terminates at said internal cylindrical surface.

8. The roof flashing of claim 6 wherein said circumferentially spaced slots are arcuate, and the radial outer sides of said slots are in substantially the same axial plane as said internal cylindrical surface.

9. The roof flashing of claim 8 wherein there are six said slots each approximately $\frac{3}{4}$ inches long and 0.075 inches wide.

10. The roof flashing of claim 1 wherein the material of said collar and base member are fused together around the periphery of said annular lip portion and said external cylindrical surface to assist in providing a weather-proof joint therebetween.

11. The roof flashing of claim 10 wherein the elastomeric material of said collar is different from the elastomeric material of said base member.

12. A roof flashing comprising a base member adapted to be secured to a roof, and a collar for establishing a weather-proof seal with an upstanding pipe passing through an opening in such roof, both said base member and collar being made of an elastomeric material, said base member having an opening therein surrounded by a stepped flange, said stepped flange including a radially inwardly extending annular lip portion having a plurality of circumferentially spaced slots therein, and an external cylindrical surface extending axially inwardly from the radial outer edge of said annular lip portion, the material of said collar extending through said slots and wrapping around said annular lip portion to form a series of closed loops providing a positive mechanical lock between said collar and base member, said collar also extending around said external cylindrical surface to aid in the formation of a fluid-tight joint between said collar and base member, said stepped flange also including a radially outwardly extending shoulder adjacent the axial inner end of said external cylindrical surface, said collar extending along the full length of said external cylindrical surface and terminating at said shoulder, said shoulder having a width slightly greater than the wall thickness of said collar along said external cylindrical surface, and said base member having an axially inwardly extending portion at the radial outer edge of said shoulder providing a substantial continuation of the outer surface of said collar to form a relatively smooth transition joint between said collar and base member.

13. The roof flashing of claim 12 wherein said base member also has an internal cylindrical surface extending axially inwardly from the bottom surface of said annular lip portion, said collar overlying the entire bottom surface of said annular lip portion and terminating at said internal cylindrical surface, said internal cylindrical surface extending downwardly below the end portion of said collar which terminates at said internal cylindrical surface.

14. The roof flashing of claim 13 wherein said circumferentially spaced slots are arcuate, and the radial outer sides of said slots are in substantially the same axial plane as said internal cylindrical surface.

15. A roof flashing comprising a base member adapted to be secured to a roof and a collar for establishing a weather-proof seal with an upstanding pipe passing through an opening in such roof, said base member and collar being made of an elastomeric material, said base member including a flat rectangular base plate and an upstanding central dome portion with a central opening therein, said dome portion having a stepped flange at the axial outermost end thereof, said stepped flange including a radially inwardly extending annular lip portion surrounding said central opening, said annular lip portion having a plurality of circumferentially spaced slots therein, the material of said collar extending through said slots and wrapping around said annular lip portion to form a series of closed loops providing a positive mechanical lock between said collar and base member, said stepped flange also including an external cylindrical surface extending axially inwardly from the radial outer edge of said annular lip portion, and a radially outwardly extending shoulder adjacent the axial inner end of said external cylindrical surface, said collar extending around said external cylindrical surface along the full length thereof and terminating at said shoulder to aid in the formation of a fluid-tight joint between said collar the base member, said shoulder having a width slightly greater than the wall thickness of said collar along said external cylindrical surface, and said stepped flange having an axially inwardly extending portion at the radial outer edge of said shoulder providing a substantial continuation of the outer surface of said collar to form a relatively smooth transition joint between said collar and dome portion.

16. The roof flashing of claim 15 wherein said dome portion also includes an internal cylindrical surface extending axially inwardly from the bottom surface of said annular lip portion, said collar overlying the entire bottom surface of said annular lip portion and terminating at said internal cylindrical surface, said internal cylindrical surface extending downwardly below the end portion of said annular lip portion which terminates at said internal cylindrical surface.

17. The roof flashing of claim 16 wherein the material of said collar and base member are fused together along the contacting surfaces between said collar and base member.

* * * * *